US006933909B2

(12) United States Patent
Theobold

(10) Patent No.: US 6,933,909 B2
(45) Date of Patent: Aug. 23, 2005

(54) MULTICHANNEL ACCESS POINT WITH COLLOCATED ISOLATED ANTENNAS

(75) Inventor: David M. Theobold, Akron, OH (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/391,099

(22) Filed: Mar. 18, 2003

(65) Prior Publication Data

US 2004/0183726 A1 Sep. 23, 2004

(51) Int. Cl.[7] ..... H01Q 21/00; H01Q 1/38

(52) U.S. Cl. ..... 343/893; 343/853; 343/899; 343/872

(58) Field of Search ..... 343/893, 853, 343/700 MS, 725, 729, 826, 872, 799; H01Q 21/00, 1/38

(56) References Cited

U.S. PATENT DOCUMENTS

| | | | | |
|---|---|---|---|---|
| 5,307,075 A | | 4/1994 | Huynh | 343/700 MS |
| 5,486,836 A | | 1/1996 | Kuffner et al. | 343/700 MS |
| 5,552,798 A | * | 9/1996 | Dietrich et al. | 343/893 |
| 5,564,121 A | * | 10/1996 | Chow et al. | 455/25 |
| 5,654,724 A | * | 8/1997 | Chu | 343/742 |
| 5,936,580 A | | 8/1999 | Van Puijenbroek | 343/700 MS |
| 5,990,838 A | | 11/1999 | Burns et al. | 343/702 |
| 6,456,242 B1 | | 9/2002 | Crawford | 343/700 MS |
| 6,469,680 B1 | | 10/2002 | Kelliher | 343/893 |
| 6,759,986 B1 | * | 7/2004 | Saliga et al. | 343/700 MS |
| 2002/0122006 A1 | | 9/2002 | Crawford | 343/702 |
| 2003/0184490 A1 | * | 10/2003 | Raiman et al. | 343/799 |
| 2004/0113861 A1 | * | 6/2004 | Jackson et al. | 343/882 |

FOREIGN PATENT DOCUMENTS

| | | |
|---|---|---|
| EP | 0 898 324 | 2/1999 |
| WO | WO 01/30039 | 4/2001 |
| WO | WO 02/31919 | 4/2002 |

* cited by examiner

*Primary Examiner*—Trinh Vo Dinh
(74) *Attorney, Agent, or Firm*—Tucker Ellis & West LLP

(57) ABSTRACT

A wireless telecommunications device is disclosed including a plurality of wireless antennas, each respectively for transmitting and/or receiving wireless signals into a predetermined sector of an omnidirectional space. A mounting structure is included for retaining the respective plurality of wireless antennas, wherein the mounting structure is configured so as to isolate the respective wireless signals.

16 Claims, 8 Drawing Sheets

MULTICHANNEL ACCESS POINT WITH COLLOCATED ISOLATED ANTENNAS

BACKGROUND OF THE INVENTION

The present application discloses embodiments directed to wireless access points for use with a wireless local area network (WLAN). In a typical wireless access point (AP), a single or dual band radio component is operated with one or more omnidirectional or directional antennas having moderate gain. The supportable throughput of an AP is typically determined by the antenna coverage pattern combined with the signal rate and modulation type provided by the radio component. With an increase of wireless traffic in a particular coverage area, it is desirable to service more users on a dense client area. It would thus be desirable to increase throughput of an AP. Several approaches have previously been used, including frequency, time, code, and polarization division multiplexing.

With Frequency Division Multiplexing (FDM), a number of signals are combined into a single channel, where each signal is transmitted over a distinct frequency sub-band within the band of the channel. However, FDM is typically limited by the channel availability of the selected wireless network standard. For example, it may be contemplated to mix three channels under the IEEE 802.11 b/g standards with eight channels under the 802.11a standard within a given physical area if co-channel interference could be mitigated. However, if channel coverages are overlapped, the resulting mutual interference imposes a scaling limitation on the network, and no throughput increase can be obtained. Also, interference is high between transmit and receive channels within collocated or nearby radio components due to antenna-to-antenna coupling, multipath interference, and electronics coupling.

With Time Division Multiplexing (TDM), a signal is divided into a number of time segments of short duration. Data from a respective number of signals is modulated into the time segments. However, TDM is limited by standards and only available if supported therein. It may be desirable to use a time-slotted protocol to enhance throughput, but such slotting might fall outside the current standards, such as with 802.11g or 802.11a, for example. While the current standards may limit throughput efficiency, compatibility requirements with the standard precludes the implementation of a TDM system.

With Code Division Multiplexing (CDM), the transmitter encodes the signal with a pseudo-random data sequence, which is also used to decode the signal. CDM can potentially raise channel utilization if suitable power control and other network management functions are imposed. However, the current AP standards do not permit incorporation of such spread spectrum modulation and multiplexing.

With polarization diversity, two separate channels are multiplexed into orthogonal polarizations of a signal carrier, thereby doubling capacity. Polarization diversity has been employed in AP technology, especially for bridges. However, performance suffers in an indoor environment containing metal grids and other multipath and depolarization propagation phenomena. Therefore, polarization diversity is not viable at the present time without employing real-time adaptive combinational techniques.

With Space Division Multiplexing (SDM) a particular coverage area is divided into sectors. In this approach, a space is divided geometrically using directional antenna beams pointed at clients to minimize coverage overlap. The directional beams may be formed electronically or by using separate apertures, as is known in the art. A common implementation is found in sectorized cellular mobile systems. However, such systems rely on large, expensive high-rejection multiplexing filters to separate transmit channels so as to not interfere with receivers on adjacent beams. This is not a suitable approach for WLAN applications due to both size and cost.

None of the above-noted solutions can satisfy the goal of raising throughput while conforming to presently accepted wireless network standards, though FDM suffers from the least number of drawbacks. A preferred solution would enable the transmit and receive channels to reside in a single AP housing along with the respective antennas. However, with such an approach it would be difficult using known techniques to avoid interference of the adjacent or alternate channels used for transmission and reception of signals.

SUMMARY OF THE INVENTION

The difficulties and drawbacks associated with previous type implementations are overcome with the present invention in which embodiments directed to a wireless telecommunications device are disclosed, including a plurality of wireless antennas, each respectively for transmitting and receiving wireless signals into a predetermined sector of an omnidirectional space, and a mounting structure for retaining the respective plurality of wireless antennas. The mounting structure is configured to isolate the respective wireless signals.

As will be realized, the invention is capable of other and different embodiments and its several details are capable of modifications in various respects, all without departing from the invention. Accordingly, the drawings and descriptions are to be regarded as illustrative and not restrictive.

DETAILED DESCRIPTION OF THE INVENTION

Figure 1A:
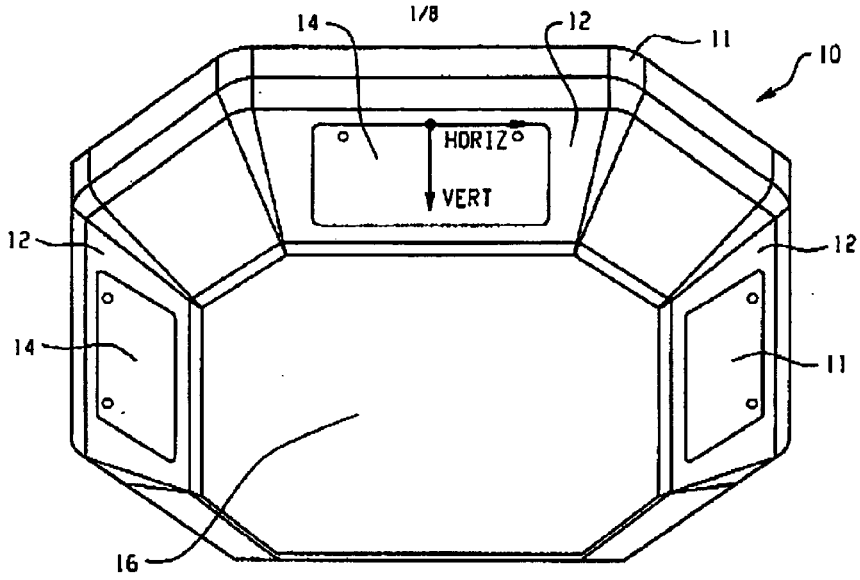
FIGS. 1A and 1B are directed to exemplary embodiments of the multichannel access point in accordance with the present invention.

A multichannel access point is disclosed herein that reduces channel-to-channel interference by providing a number of collocated, isolated antennas, as will be set forth in detail below. In the preferred embodiment, the present multichannel AP divides an omnidirectional coverage area into discrete sectors so that a particular one of a plurality of wireless antennas is used to transmit and receive wireless signals into a specific sector of the omnidirectional space. Throughput over the omnidirectional coverage area is thereby raised by a factor equal to the number of sectors.

In one aspect of the present invention, a plurality of patch antennas is employed. In the preferred embodiment, a linearly polarized patch antenna having a parasitic element can be used, such as is disclosed in U.S. Ser. No. 10/146,609, the disclosure of which is hereby incorporated by reference. Such a patch antenna has a desirable front-to-back ratio and low depolarization. It has been found that mounting such antennas with a certain separation, orientation, and inclination provides a surprising amount of antenna isolation, thereby enabling the omnidirectional space to be sectorized, with the resulting increases in access point throughput.

A linearly polarized patch antenna with a parasitic element (as indicated above) has a front-to-back ratio of about 20 dB. That is to say, the antenna gain in a forward direction is one hundred times greater than in a 180-degree direction from the forward direction. It has been found that additional isolation is obtained if such patch antennas are mounted in a co-planar arrangement with a separation of two or more wavelengths. Preferably, the antennas are separated by a distance of about 10 inches on center (for 5 GHz), which has been found to raise the antenna isolation to 40 dB. However, separations of between 5 and 15 inches can be used to produce acceptable isolation levels, to accommodate various design objectives. Additional isolation is obtained by mounting the antennas at an angle of inclination from each other. In this way, the front-to-back ratios of the antennas are oriented to minimize energy coupling between each other. Also, such an arrangement increases polarization orthogonality between respective antenna pairs. Preferably, each antenna plane is rotated to an angle of 45 degrees, so that their normals are at right angles. A scheme such as this has been found to result in an antenna isolation of about 50 dB.

A mounting structure is provided herewith for retaining the respective wireless antennas, and configured so as to obtain the above-noted isolation of the respective wireless signals associated with the antennas. As shown in an exemplary embodiment of FIG. 1, four patch antennas 14 are mounted on a square mounting structure 11 with slanted sides 12, preferably inclined at an angle of 45 degrees. In this manner, each of the respectivc antennas 14 are configured so as to be mutually orthogonal with each other. In a patch antenna 14 as presently contemplated, the horizontal polarization "H" is defined as parallel to the plane of the base and the vertical polarization "V" is normal to the horizontal polarization.

Figure 1B:
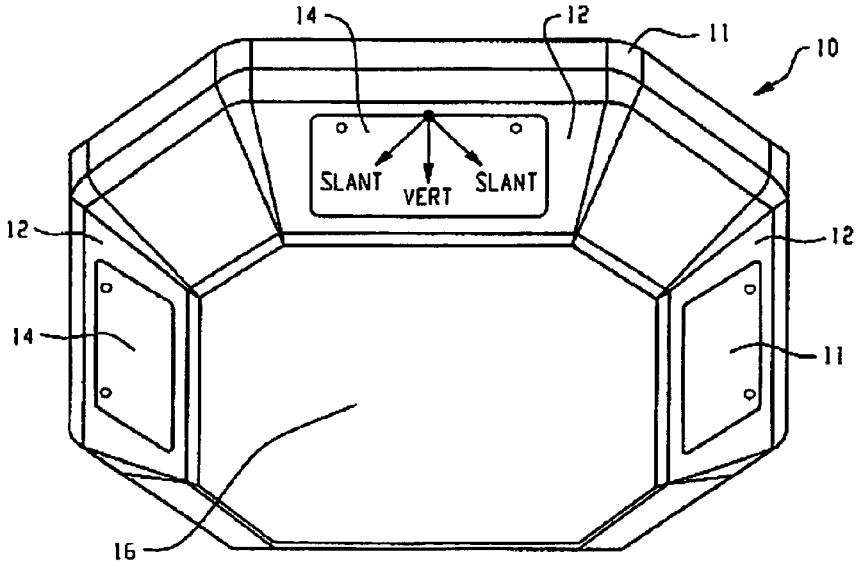
Figure 2:
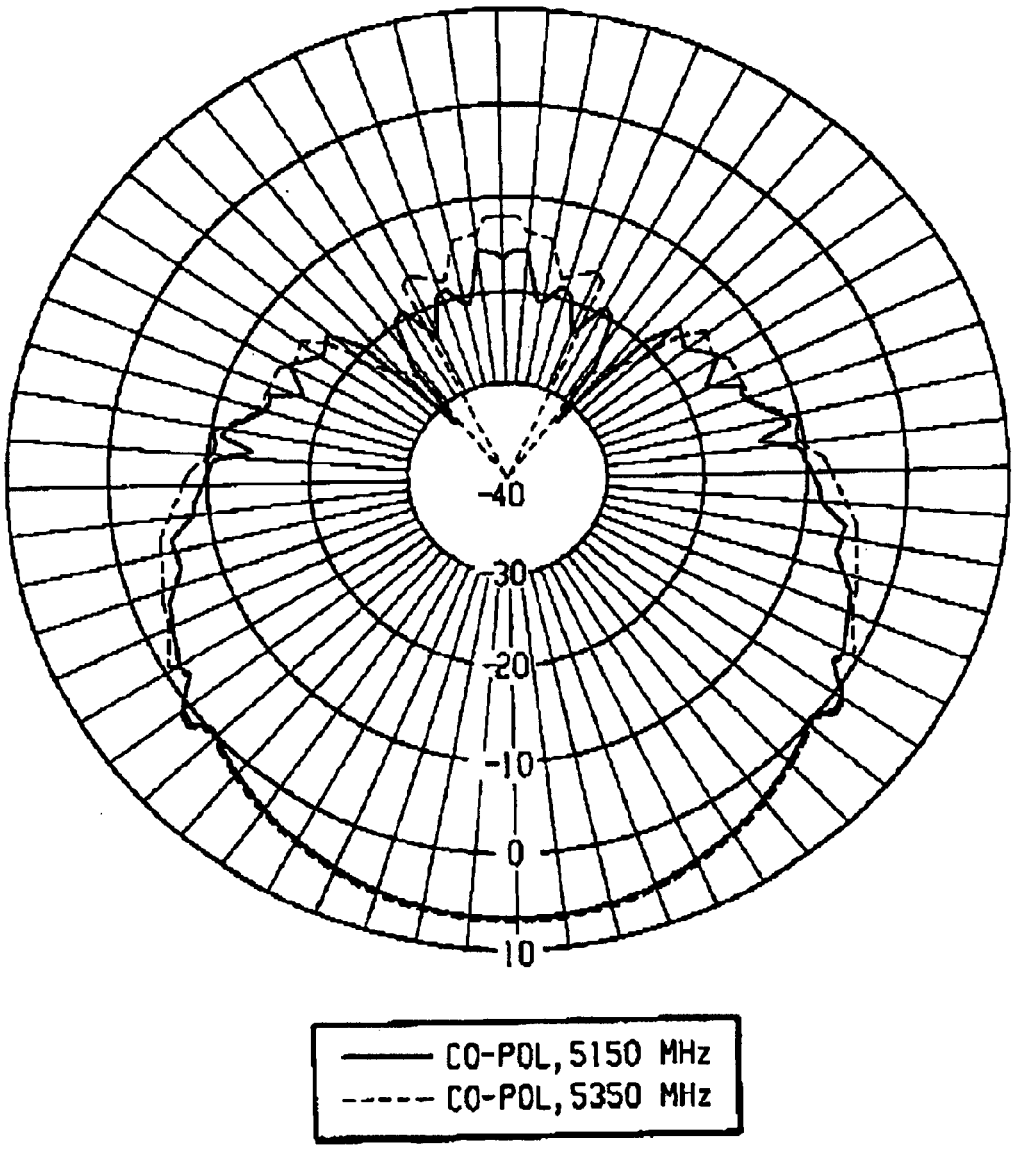
FIG. 2 is a gain pattern showing gain for a patch antenna used in accordance with an exemplary embodiment of the present invention.

The patch antennas in the exemplary embodiment of FIG. 1 are oriented 45 degrees from normal to a face surface 16 of the mounting structure 11. As a result, the "scallop" or crossover angle of the gain pattern is 45 degrees relative to the azimuthal plane. The crossover angle of the angle normal to the face surface 16 is 90 degrees or less, i.e. out to the sides of the face surface 16 and lower, for an access point mounted on the ceiling. The corresponding angle of the pattern is found to be 60 degrees off boresight. As shown in the E-plane pattern of FIG. 2, the gain of this point is about −2 dB, which corresponds to horizon relative to a ceiling-mounted AP. All angles directed toward the floor would have higher gain, resulting in satisfactory crossover coverage for servicing a mobile client. In addition to the advantages mentioned above, the antenna pattern of the exemplary embodiment does not have a downwardly directed null, since the sides are slanted outward, thereby skewing the directive pattern. Thus, the present access point 10 is well suited for providing wireless coverage to a high-density client area with near-line-of-sight propagation characteristics, e.g. a conference room, lecture hall, etc.

Figure 6A:
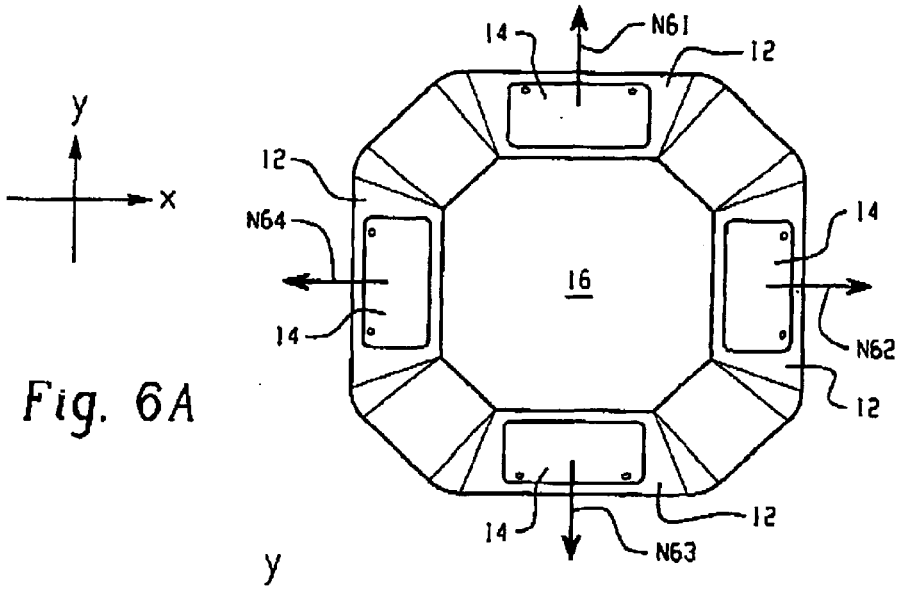
FIG. 6A is a top view of the antenna system employed by the multi-channel access point of FIG. 1A and 1B.
Figure 6B:
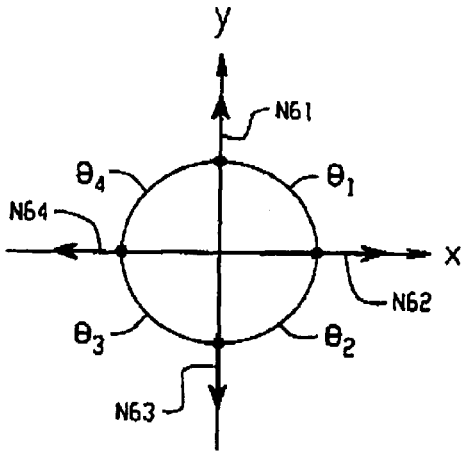
FIG. 6B is a graphical representation of a of normals from the surfaces of the antenna elements in a horizontal plane.
Figure 6C:
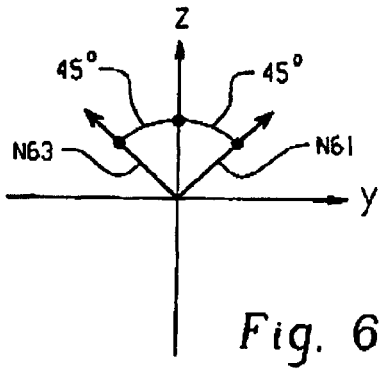
FIG. 6C is a graphical representation of a first pair of normals from two surfaces of a first pair of antenna elements in illustrated in FIG. 6A from the perspective of a first vertical plane orthogonal to the horizontal plane of FIG. 6B.
Figure 6D:
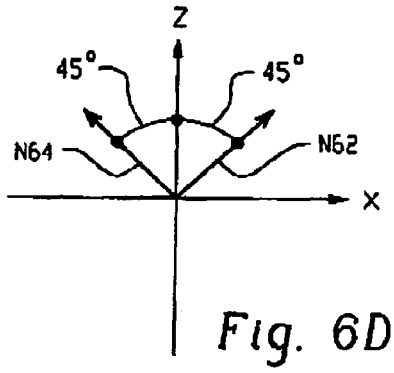
FIG. 6D is a graphical representation of a second pair of normals from two surfaces of a second pair of antenna elements in illustrated in FIG. 6A from the perspective of a second vertical plane orthogonal to the horizontal plane of FIG. 6B.

Referring to FIG. 6A, there is illustrated a top view of the embodiment of FIG. 1 showing the normals N61, N62, N63, N64 to slanted sides 12, which is the direction that the beams from patch antennas 14 are directed. FIG. 6B illustrates the orientation of normals N61, N62, N63, N64 in the X-Y plane and the angles between them in the X-Y plane where θ1 is the angle normals N61 and N62, θ2 between, N62 and N63, θ3 between N63 and N64 and θ4 between N64 and N61. In a two dimensional system, e.g., a system in the X-Y plane only, N61 is perpendicular (and orthogonal) to N62 and N64, N62 is perpendicular to N61 and N63, N63 is perpendicular to N62 and N64 and N64 is perpendicular to N63 and N61; however, the angles between N61 and N63 and N62 and N64 is 80 degrees (θ1+θ2 or θ3+θ4; θ2+θ3 or θ4+θ1 respectively) in the X-Y plane. However, because the sides are slanted, the angle of inclination of the slant is suitably selected so that N61, N63 and N62, N64 are also perpendicular to each other. In the case of the 4 sided figure as shown in FIGS. 1 and 6A, the angle is about 45 degrees. As can be observed in FIG. 6C, because of the 45 degree angle of inclination, normals N61 and N63 are perpendicular in the Y-Z plane. Likewise, as can observed in FIG. 6D, because of the 45 degree angle of inclination, normals N62 and N64 are perpendicular in the X-Z plane. Thus, in accordance with an aspect of the present invention, all of the normals, or the direction in which the beams of patch antenna 14 are directed are perpendicular to each other.

Figure 3A:
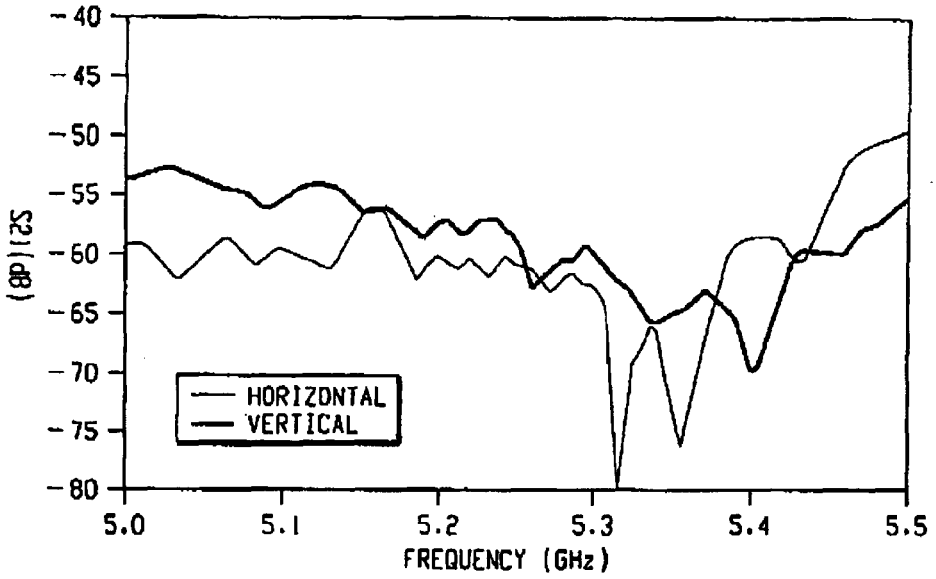
FIGS. 3A and 3B compare antenna isolation characteristics in horizontal and vertical polarizations for antennas on opposite and diagonal sides respectively of an exemplary embodiment of the present invention.
Figure 3B:
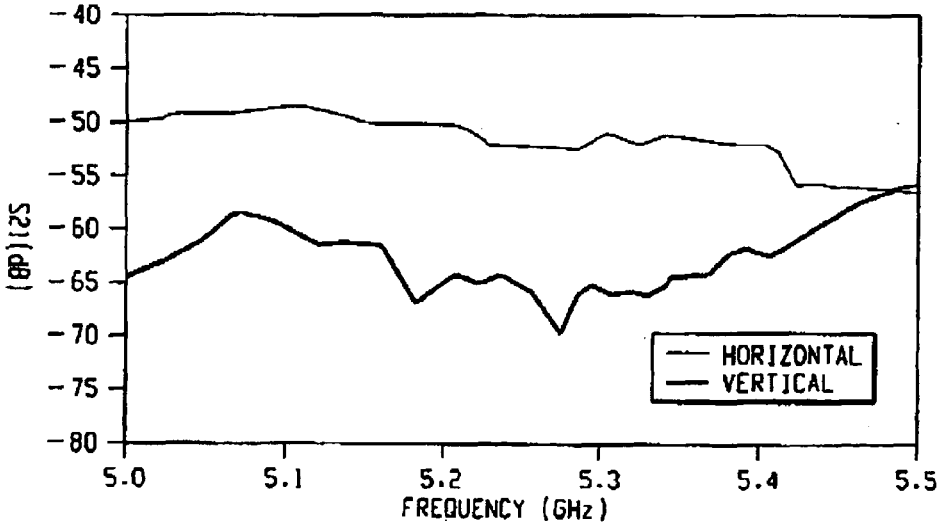
Figure 4:
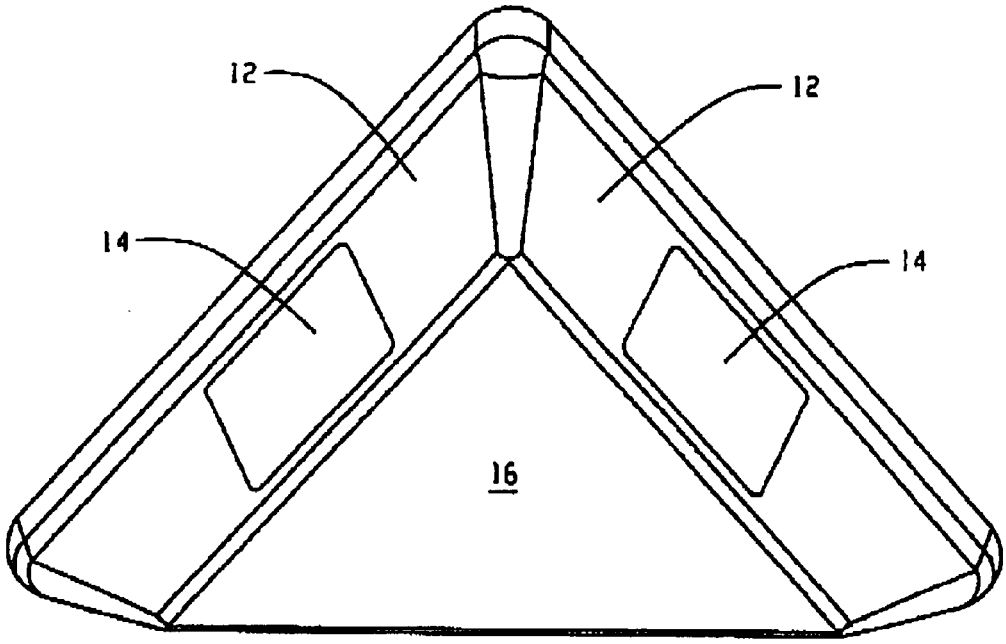
FIG. 4 shows an alternate embodiment of an access point in accordance with the invention having a triangular configuration.
Figure 5A:
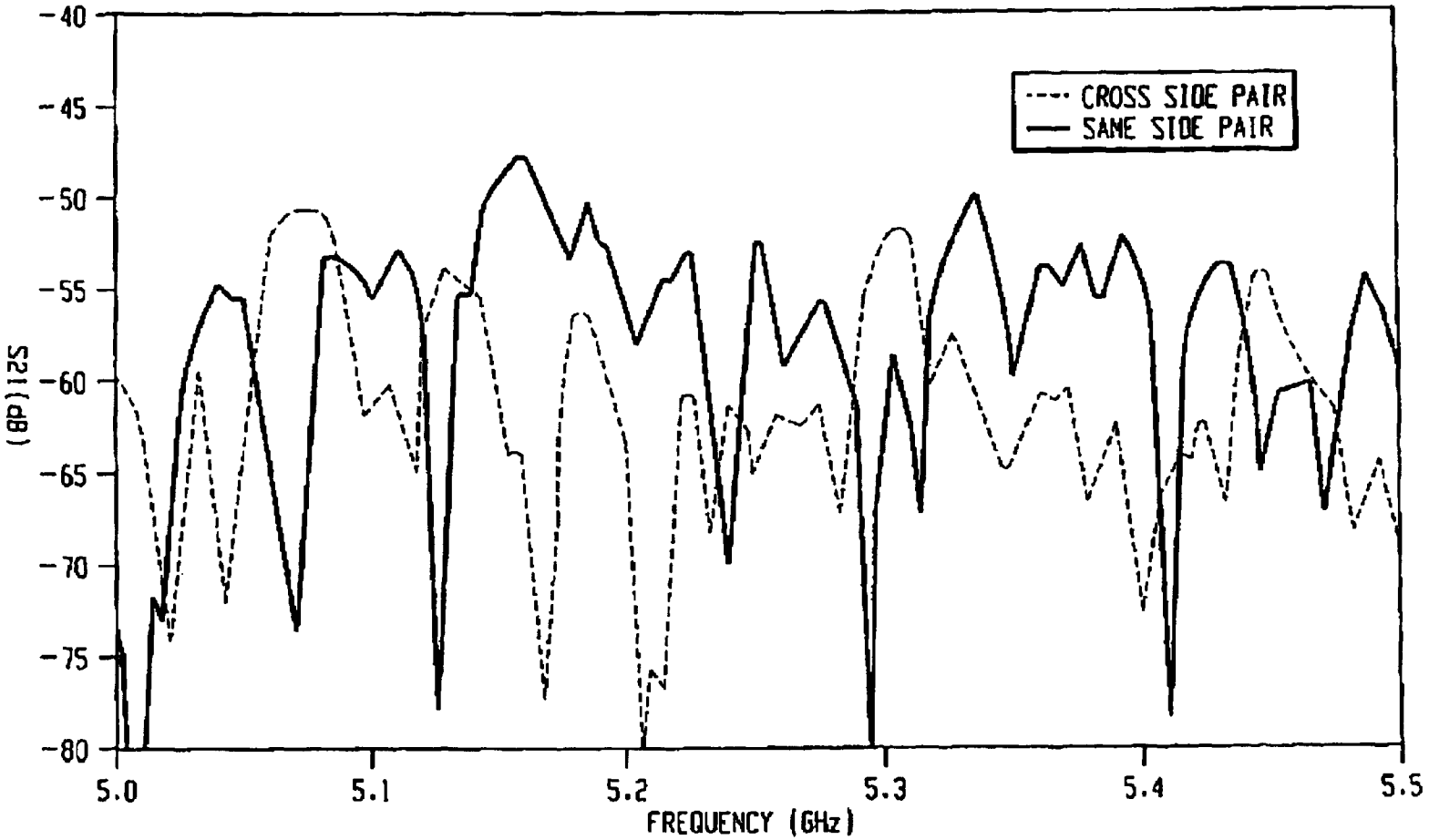
FIGS. 5A and 5B compare antenna isolation characteristics for slant polarizations for diversity antenna pairs on opposite and diagonal sides respectively of an exemplary embodiment of the present invention.
Figure 5B:
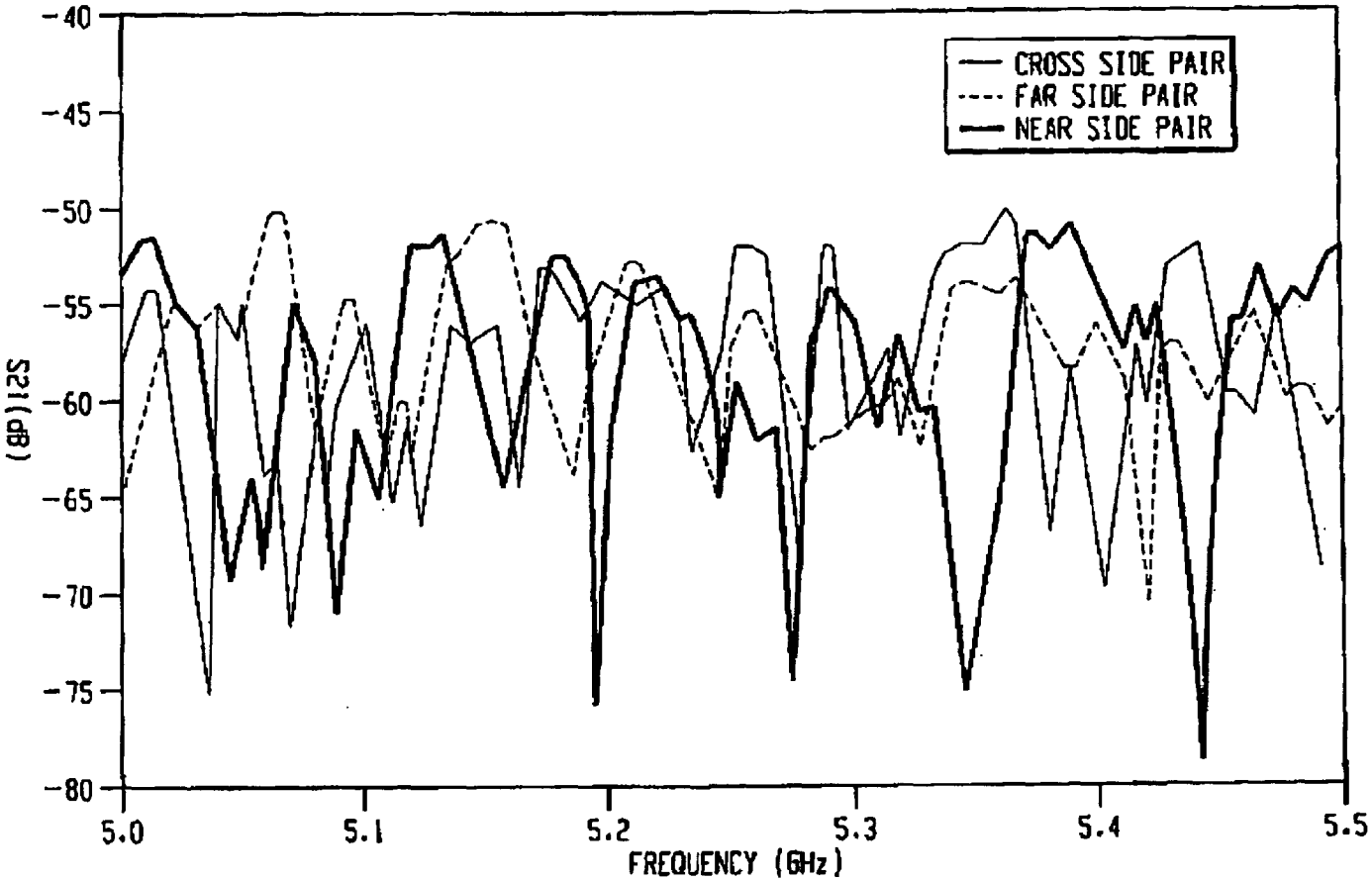

FIGS. 3A and 3B are graphs exhibiting isolation characteristics for vertically and horizontally polarized patch antennas located on opposite and diagonal sides of the exemplary access point. For the frequency bands of interest, from 5.18 to 5.32 GHz, the vertical polarization for antennas on all four faces results in signal isolation of 57 dB or better. The present invention is preferably implemented with a specification signal and coverage is preferably achieved by using combinations of signals under the IEEE 802.11 b/g as well as 802.11a protocols, and the antennas can be operable simultaneously in any combination of transmit or receive mode. Also, it should be noted that the present access point is not limited to the four-sided topology of the exemplary embodiment. Many other topologies can be envisioned, including triangular enclosures, with suitable antenna elements and polarizations, all without departing from the invention. For example, a triangular configuration as shown in FIG. 4 would have sides with an inclination of 32 degrees in order to obtain the desired 90-degree face normals. The present invention can also be accommodated with a diversity antenna system in which switching occurs between antennas, in order to mitigate multipath distortion. In using pairs of diversity antennas with the exemplary embodiment of FIG. 1B, the first pair is configured to have vertical polarization "Vert", parallel to the side of the access point 10. The second pair has "slant" polarization "Slant" where one patch has a polarization slanted at 45 degrees left of "V" and the other patch has polarization slanted 45 degrees to the right. As shown in FIGS. 5A and 5B, the isolation characteristics are shown respectively for diversity pairs mounted respectively on opposite sides and adjacent diagonal sides. The slant polarization characteristics provide excellent isolation for an opposite sided diversity pair, on the order of about −52 dB across the desired wireless band. Thus, diversity antennas with slant polarization offer good performance with the present access point. Compared to the previously indicated embodiment in which single patch antennas are mounted at 45 degrees, an isolation penally of 6 dB is observed with a diversity arrangement. However, a diversity scheme offers the benefit of decreased side-to-side separation and optimized coverage over the client area.

Figure 7A:
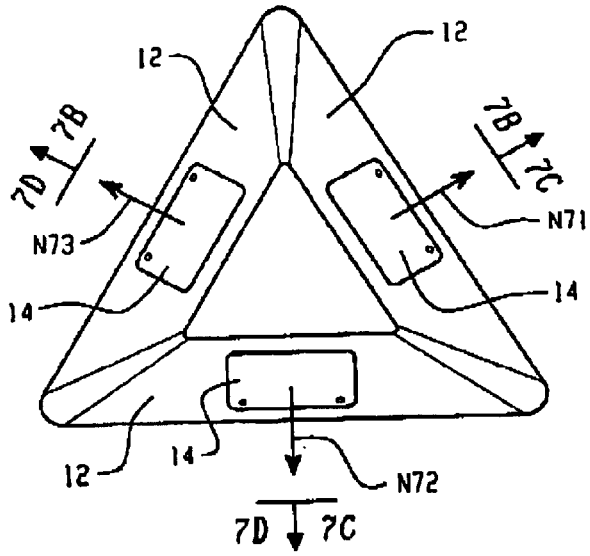
FIG. 7A is a top view of a three sided antenna system employed by the multi-channel access point of FIG. 4.
Figure 7B:
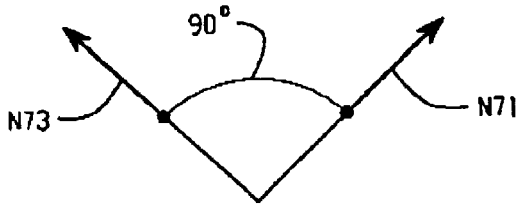
FIG. 7B is a graphical representation of the normals to a first pair of antenna elements illustrated in FIG. 7A.
Figure 7D:
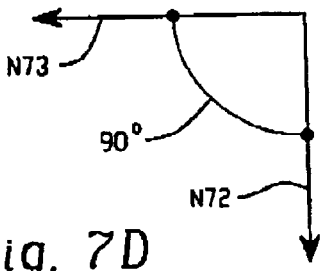
FIG. 7D is a graphical representation of the normals to a third pair of antenna elements illustrated in FIG. 7A.
Figure 7C:
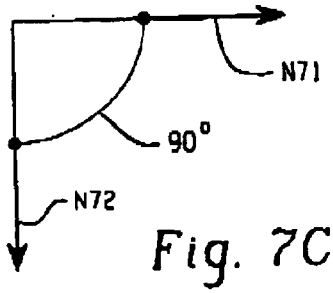
FIG. 7C is a graphical representation of the normals to a second pair of antenna elements illustrated in FIG. 7A.

FIG. 7A is a top view of the exemplary embodiment of FIG. 4. Normals 71, 72, 73 are normal to their respective surface 12 and indicative the direction of the beam from the corresponding patch antennas 14. As in the case with FIG. 6, although the angles between normals 71, 72, 73 is greater than 90 degrees, the desired 90 degree face normals are obtained by the angle of inclination of slanted sides 12 with face surface 16, which in this embodiment is about 32 degrees. The 90 degree angles between face normals are illustrated in FIG. 7B for N73, N71, FIG. 7C for N71, N72 and FIG. 7D for N72, N73, which are views taken from lines 7B–7C, 7C–7D, 7D–7B respectively.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the area within the principle and scope of the invention will be expressed in the appended claims.

What is claimed is:

1. A wireless telecommunications device consisting of:

four wireless antennas, each respectively for at least one of transmitting and receiving wireless signals into a predetermined sector of an omnidirectional space; and a mounting structure comprising slanted sides for retaining the respective four wireless antennas;

wherein the predetermined sector for each antenna is normal to the slanted side retaining the antenna; and wherein the mounting structure is configured so that the normals of the all slanted sides retaining the four wireless antennas are nearly mutually perpendicular with each other.

2. The wireless telecommunications device of claim 1 wherein at least one of the wireless antennas comprises a patch antenna having a predetermined front-to-back ratio and depolarization.

3. The wireless telecommunications device of claim 1 wherein the mounting structure is configured to retain the respective wireless antennas at a predetermined separation from each other.

4. The wireless telecommunications device of claim 3 wherein the predetermined separation between the respective antennas is at least two wavelengths of the wireless signals.

5. The wireless telecommunications device of claim 1 wherein each of the four wireless antennas transmit and receive signals over the same wireless signal bandwidth.

6. The wireless telecommunications device of claim 1 wherein each antenna covers a different predetermined sector of the omnidirectional space.

7. The wireless telecommunications device of claim 1 wherein the four antennas comprise at least one diversity antenna pair.

8. A system of collocated, isolated antennas, comprising:

four unidirectional wireless antennas, each respectively for at least one of transmitting and receiving wireless signals in a predetermined direction; and a mounting structure with no more than four slanted antenna-retaining sides wherein each of the antenna-retaining sides retains one of the respective four wireless antennas, and the mounting structure is configured such that the predetermined direction of each of the four unidirectional antenna is normal to its corresponding slanted antenna-retaining side and the predetermined directions of all the wireless antennas are nearly mutually perpendicular with each other.

9. The system of collocated, isolated antennas of claim 8, wherein at least one of the wireless antennas comprises a patch antenna having a predetermined front-to-back ratio and depolarization.

10. The system of collocated, isolated antennas of claim 8 wherein each of the four wireless antennas transmit and receive signals over the same wireless signal band.

11. The system of collocated, isolated antennas of claim 8 wherein the four antennas comprise at least one diversity antenna pair.

12. The system of collocated, isolated antennas of claim 8, wherein at least one of the four unidirectional wireless antennas comprises a linearly polarized patch antennas with a parasitic element.

13. The system of collocated, isolated antennas of claim 12, wherein the patch antennas has a front to back ratio of at least 20 dB.

14. The system of collocated, isolated antennas of claim 8, the mounting structure further comprising a face surface coupled to the slanted sides, wherein angle of inclination between the face surface and each of the slanted sides retaining the four wireless unidirectional antennas is about 45 degrees.

15. The system of collocated, isolated antennas of claim 14, wherein at least one of the four unidirectional wireless antennas comprises a linearly polarized patch antennas with a parasitic element.

16. The system of collocated, isolated antennas of claim 15, wherein the patch antennas has a front to back ratio of at least 20 dB.

* * * * *